US005921390A

United States Patent [19]

Simhaee

[11] Patent Number: 5,921,390

[45] Date of Patent: Jul. 13, 1999

[54] CONTINUOUS ROLL OF PLASTIC BAGS

[76] Inventor: Ebrahim Simhaee, 112 N. Maple Dr., Beverly Hills, Calif. 90210

[21] Appl. No.: 09/059,436

[22] Filed: Apr. 9, 1998

Related U.S. Application Data

[60] Provisional application No. 60/043,303, Apr. 11, 1997.

[51] Int. Cl.[6] ..... B65D 33/00

[52] U.S. Cl. ..... 206/390; 383/35; 383/37

[58] Field of Search ..... 206/390; 383/35, 383/37

[56] References Cited

U.S. PATENT DOCUMENTS

| | | | |
|---|---|---|---|
| 3,098,594 | 7/1963 | Williamson | 206/390 |
| 3,254,828 | 6/1966 | Lerner | 383/37 |
| 3,979,050 | 9/1976 | Cilia | 383/35 |
| 4,349,123 | 9/1982 | Yang | 206/390 |
| 4,759,742 | 7/1988 | Achelpohl | 383/37 |
| 4,846,349 | 7/1989 | Galimberti | 206/390 |
| 4,849,090 | 7/1989 | Case et al. | 206/390 |
| 4,904,092 | 2/1990 | Campbell et al. | 383/35 |
| 5,170,957 | 12/1992 | Carpenter | 206/390 |
| 5,433,363 | 7/1995 | Simhaee . | |
| 5,752,666 | 5/1998 | Simhaee | 206/390 |

FOREIGN PATENT DOCUMENTS

| | | | |
|---|---|---|---|
| 541028 | 5/1993 | European Pat. Off. | 383/37 |
| 44 07 761 A1 | 9/1995 | Germany . | |

*Primary Examiner*—Stephen P. Garbe
*Attorney, Agent, or Firm*—Darby & Darby

[57] ABSTRACT

A multi-ply plastic bag from a continuous strip of bags on a roll is supplied to a user with the top of the bag partially opened. A tear line between the bottom of a leading bag and a top of a subsequent bag separates the individual bags. A broad slit centrally located in the tear line passes through all but one ply of the strip of bags. The bag dispenser has an upwardly projecting tongue which engages the slit in the tear line when a user draws a bag from the dispenser. The tongue impedes the subsequent bag from moving forward. The adjacent bags separate along the tear line. The ply which does not have a slit rides over the tongue and pulls apart the plies at the opening of the subsequent bag before the leading bag completely separates from the subsequent bag.

7 Claims, 2 Drawing Sheets

CONTINUOUS ROLL OF PLASTIC BAGS

This application claims priority pursuant to U.S.C. 35 §119 from U.S. provisional application Ser. No. 60/043,303 filed Apr. 11, 1997, the entire disclosure of which is hereby incorporated by reference.

FIELD OF THE INVENTION

The present invention, in general, relates to plastic bags and more particularly, to a roll of plastic bags that are readily openable when supplied in continuous strips.

BACKGROUND OF THE INVENTION

In a supermarket or food market, fresh produce is often displayed in bulk, possibly in piles of loose items. Consumers must take a bag from a nearby source, and then select and bag their own fruits and vegetables. Typically, the source of bags is a vertically or horizontally positioned cylindrical roll of flattened multi-ply plastic film bags supplied in continuous strips. The bags have perforated separation lines between them. Separation is accomplished by pulling the leading bag from the next bag on the role, and may be assisted by bag dispensing devices such as those disclosed in applicant's U.S. Pat. Nos. 5,135,146, 5,261,585 and 5,433,363, which allow single-handed separation of a bag from the strip. A problem with bags provided on a continuous strip is that the user often finds it difficult to open the bag once it has been removed from the strip. The user may in fact find it difficult to determine which end of the removed bag is the end that opens. The slick finish of the thin film walls of the bag, the static adhesion of thin plastic films and the perforation forces applied to the films in order to provide the separation lines may cause the plies at the opening of the bag to resist separation. A user may be required to employ two hands to open the bag. This can be a nuisance when the consumer has already selected and is holding items to be placed in the bag.

An object of the present invention is to provide plastic bags that, even when supplied in continuous strips, are readily openable.

A further object is to provide a produce bag which is presented to the user in a partially opened state.

A further object of the invention is to provide a continuous strip of produce bags on a roll such that removing a leading bag from the roll readily identifies the opening end of an adjacent successive bag on the roll.

SUMMARY OF THE INVENTION

In accordance with the invention, a continuous strip of plastic bags is preferably wound around on an axle adapted for use in, for example, the dispensing devices disclosed above. The bags may be of any configuration, but are preferably in a "sealed stack" configuration, in which the continuous strip of bags is longitudinally folded so that a cross-section of a single bag presents multiple plies of plastic film. Each bag is defined by a lateral separation line, usually a perforated tear-line, between the bottom edge of the leading bag and the top edge of the successive bag. The bag opening is in the top edge of each bag. Approximately in the center of the separation line on the folded bag is an opening which preferably passes through all but one ply of the bag. The opening in the separation line is adapted to engage a tongue mounted on the supporting dispenser. As the user pulls a bag from the dispenser, the tongue engages the openings; continued pulling causes the tongue to separate the leading bag along the tear-line, eventually leaving the ply without an opening connecting the leading bag and the successive bag.

This connecting portion, or connecting web, is the last portion to be torn before the leading bag is completely separated from the continuous strip. The final force required to overcome the attachment of the connecting portion deforms the bag and causes at least the connected ply of the folded plies to separate from the other plies at the bag opening. The separated plies at the opening of the bag are available for the user to grasp and readily open the bag fully.

BRIEF DESCRIPTION OF THE DRAWINGS

The foregoing and other objects and advantages of this invention will become apparent to those skilled in the art upon reading the detailed description of a preferred embodiment in conjunction with a review of the appended drawings in which.

DETAILED DESCRIPTION OF THE INVENTION

Figure 1:
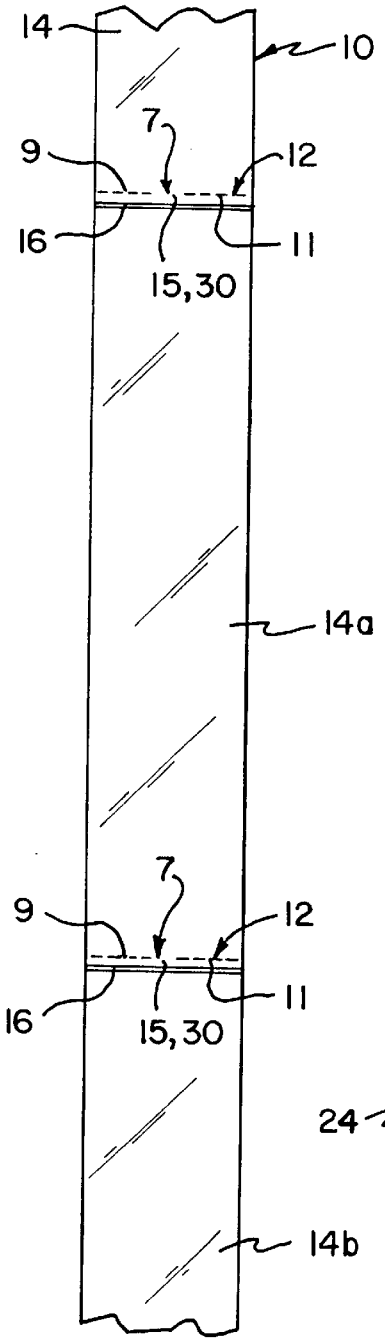
FIG. 1 is a top view of a portion of a continuous strip of bags detailing separation lines between bags.

Referring to FIG. 1, a portion of a continuous strip of bags 14 of the invention is shown generally at 10. The strip of bags 10 may be formed of at least two plies 18 of a film from any one of a number of film-forming plastics well known in the art. The plies have confronting faces 41 and 42. In the preferred embodiment, each bag 14 is connected at one end to the end of an adjacent bag by a continuous portion or web of at least one of the plies of the plastic film. Each bag 14 is readily separable from the successive bag along a line of weakness, or separation line 12. In the preferred embodiment, a perforated tear line, shown as segments 9 and 11, pierces the contiguous portion of plastic film connecting adjacent bags 14, to substantially form the separation line 12 between adjacent bags on the continuous strip 10. The perforations in the tear line segments 9 and 11 pass through all of the plies 18 of the continuous portion of the strip 10. A bottom seam 16, proximal and generally parallel to the separation line 12, may form the sealed bottom end of each bag 14. One or both sides of the bag may be formed of continuous plastic film material, or one or both sides may be formed by joining separate plies of material with a side seam (not shown). The bottom seam 16 and side seams are typically formed by welding, but may be formed by any conventional means. The separation line 12 may also define a top edge 7 of each bag 14. The top edge 7 of the bag 14 defines a bag opening 35 which leads into a bag cavity.

Figure 2:
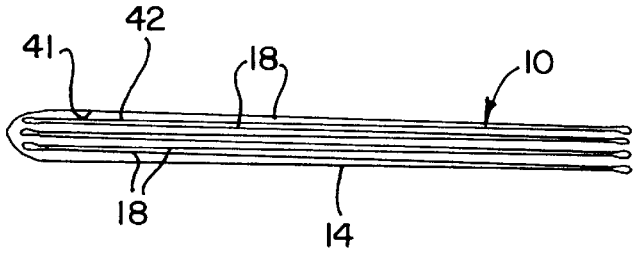
FIG. 2 is a cross-section taken along sectional line 2—2 in FIG. 1, showing the multiple plies of a folded bag.

Referring now to FIG. 2, the continuous strip 10 of bags 14 may be of any configuration, but is preferably in a "star sealed" configuration, in which the continuous strip 10 of bags 14 is folded longitudinally along the strip 10 so that a cross-section of a single bag 14 has eight plies 18 of plastic film. The folded continuous strip 10 of bags 14 is wound into a roll of bags, shown in FIG. 3 at 22, which may be supported in a dispenser 24, or may be arranged and supported in other conventional ways known in the art. With the strip 10 folded into multiple plies 18, the roll 22 of bags 14 presents a narrower, more convenient profile for display and dispensing. In the preferred embodiment, the bags 14 are dispensed from the outer perimeter of the roll of bags 22. Although dispensing a continuous strip 10 of bags 14 from a roll 22 is preferred, other means and other devices for dispensing continuous strips 10 of bags 14 are known to those skilled in the art and are contemplated by the inventor, such as, for example, a continuous strip of bags which is transversely folded and dispensed from a box or container.

The separation line 12 has a non-perforated portion 15, in at least one of the plies 18, forming a connector web 30 located between perforated tear line segments 9 and 11. The connector web 30 is dimensioned to provide a substantially greater resistance to separation than the perforated tear line segments 9 and 11. It is further dimensioned to provide sufficient force to the top edge 7 of the bag 14 to separate at least one ply 18 from another ply 18 at the bag opening 35. In the preferred embodiment, the connector web 30 is integrally formed and contiguous with the plastic film material of the uppermost ply 18*a* of the bag 14, but may be formed by more than one ply 18, or may be a single ply 18 other than the uppermost ply. The connector web 30 may be wider than shown, for example possibly even equal to the full width of the ply.

As noted above, the connector web 30 is preferably a contiguous portion of at least one ply 18 of the strip 10. Each ply 18 that is not connected by a web 30 in the strip 10 instead has a tear line opening 28 between perforated tear line segments 9 and 11. The tear line opening 28 in each ply 18 not connected by a web 30 is substantially the same width as and arranged to be aligned with the web 30.

When a leading bag 14*a* is drawn away from a successive bag 14*b* on the continuous strip 10, the bottom 16 of the leading bag will separate from the top 7 of the successive bag along the perforated tear line segments 9 and 11 of separation line 12. At this stage in the separation process, the plies 18 that are not connected by a web 30 are also separated from the continuous strip 10 by tear line slit 28. Subsequent to separation of the bags 14*a* and 14*b* at the perforated tear line segments 9 and 11, and at the tear line slit 28, only web 30 connects adjacent bags 14*a* and 14*b*. Web 30 is the last connecting portion to be torn before the drawn bag 14*a* separates from the successive bag 14*b*. However, as continued force is applied to severe web 30 and separate the leading bag 14*a* from the successive bag 14*b*, the ply 18*a* to which the web 30 is attached in the successive bag 14*b*, is drawn away from the other plies at the bag opening 35 in the successive bag 14*b*, resulting in a partially open successive bag 14*b*.

In the preferred embodiment, the dispenser 24 supports the roll of bags 22 and guides the lead bag 14*a* from the outer perimeter of the roll over an upwardly directed tongue or finger 26. The tongue is arranged to be aligned with the tear line slit 28. In response to a user drawing a leading bag 14*a* down and away from the dispenser 24, the roll 22 moves in the direction of arrow 23, and the leading bag 14*a* and subsequent bag 14*b* move in the direction of arrow 25 towards tongue 26. The lower ply 18*c* of the leading bag 14*a* slides over the tongue 26 until the tongue 26 enters and engages the tear line slit 28 of at least one ply 18*c*, but preferably all but one ply 18*a* which has a connector web 30 instead of a tear line slit 28. Because the tear line slit 28 does not pass through the web 30, the web 30 rides up and over the tongue 26 as the leading bag 14*a* is drawn away from the subsequent bag 14*b*. The tongue 26 by engaging the tear line slit 28, engages a portion of the top edge 7 of the subsequent bag 14*b* proximal to the tear line slit 28. Further forward movement of the engaged portion of the successive bag 14*b* is substantially impeded by the tongue 26. Thus, as continued force is applied to draw the leading bag 14*a* away from the engaged portion of the subsequent bag 14*b*, the leading bag 14*a* and the subsequent bag 14*b* begin to separate along perforated tear lines 9 and 11. Simultaneously, web 30 conveys a portion of the ply 18*a* of subsequent bag 14*b*, to which it is attached, over and beyond the tongue 26, and confronting faces 41 and 42 separate. Eventually, the leading bag 14*a* and subsequent bag 14*b* are detached along both perforated tear lines 9 and 11. At this stage in the separation process, the leading and subsequent bags, 14*a* and 14*b* are still connected by web 30, as web 30 is dimensioned to provide substantially greater resistance to separation than perforated tear lines 9 and 11. Further force must be applied to overcome the connection of web 30, to allow the leading bag 14*a* to be completely separated from the subsequent bag 14*b*. As the leading bag 14*a* is drawn away from subsequent bag 14*b* in response to additional force by the user, the ply 18*a*, to which web 30 is connected in the subsequent bag 14*b*, pulls away from the plies 18 in the subsequent bag 14*b* which are engaged by tongue 26, further separating confronting faces 41 and 42, so that a portion of the subsequent bag 14*b* opens. Connector web 30 then tears, and the leading bag 14*a* completely separated.

Figure 3:
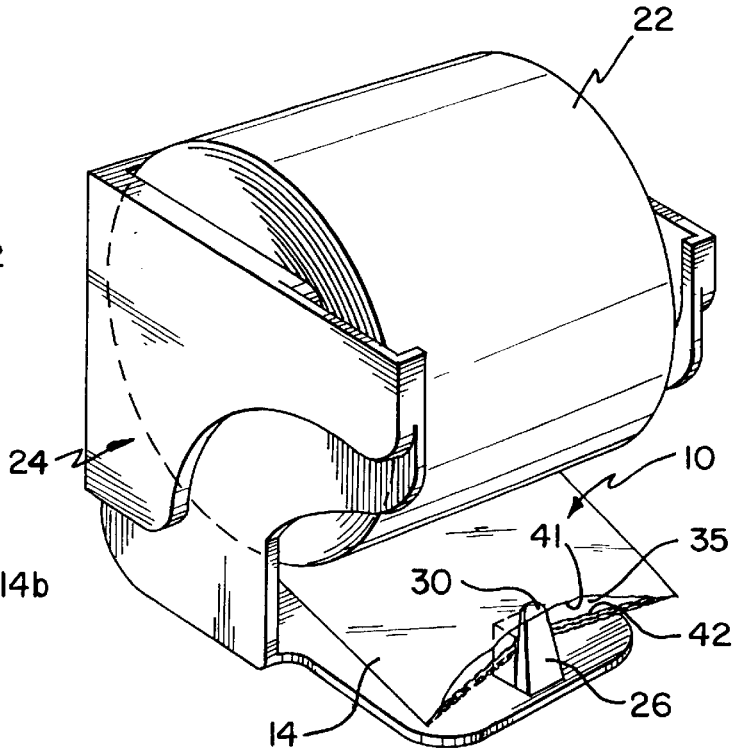
FIG. 3 is a perspective view of a roll of bags in a continuous strip supported in a dispenser.
Figure 4:
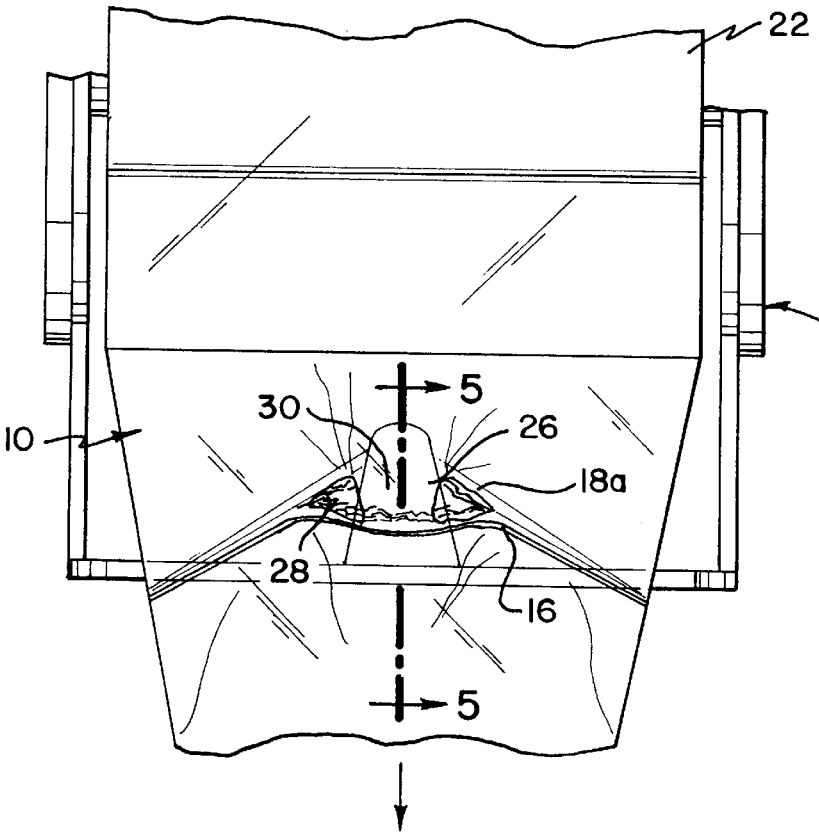
FIG. 4 is a front view of the dispenser tongue engaging an opening which passes through all but the topmost ply of the separation line.
Figure 5:
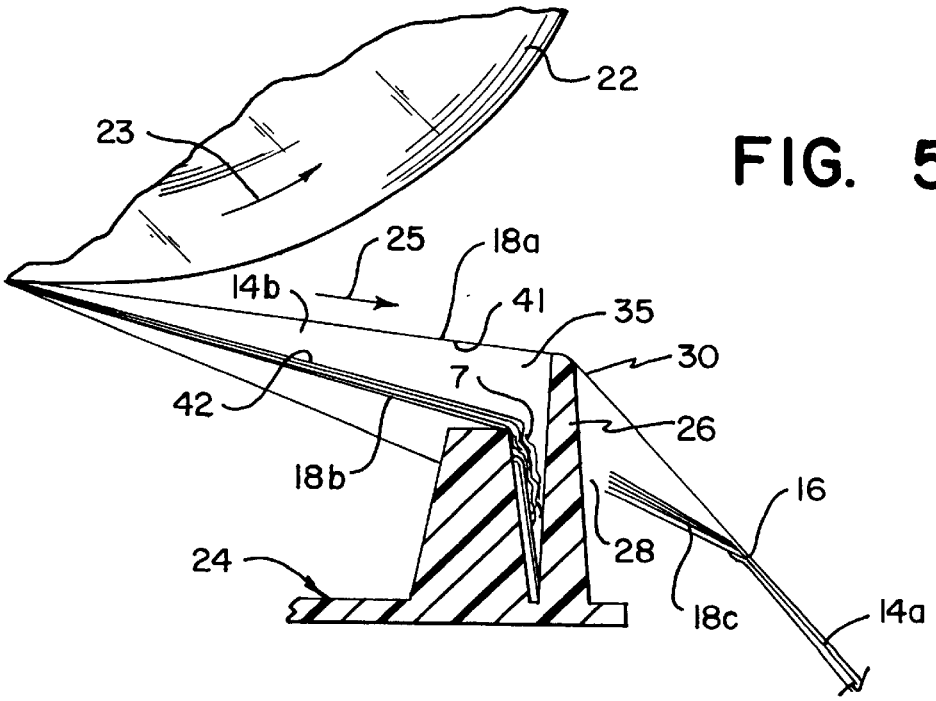
FIG. 5 is a side cross-section taken along sectional line 5—5 of FIG. 4 showing the dispenser tongue engaging the opening which passes through all but the topmost ply of the separation line.

With the leading bag 14*a* completely separated, subsequent bag 14*b* becomes the leading bag 14*a*. A portion of the bag is still engaged by tongue 26, and as illustrated in FIG. 3, the bag 14 sits partially opened at 35 and ready to be supplied to the next user. The next user simply grasps the bag and lifts the engaged portion from the tongue to allow the bag to be drawn away from the roll 22. After a bag 14 has been separated from the roll 22, the user can readily identify the partially opened end 35 of the bag 14, and the user can grasp and readily separate the plies 18 to open the bag 14.

While the embodiments of the invention shown and described are fully capable of achieving the results desired, it is to be understood that the embodiments have been shown and described for purposes of illustration only and not for purposes of limitation.

What is claimed is:

1. A continuous roll of separable plastic bags for use in a dispenser which includes a separating tongue in a predetermined position, each of said bags comprising:

a multiplicity of plies of flexible plastic film;

a tear line in each of said plies, each of said tear lines overlying each other and including a perforated portion;

at least a first of said plies including an elongated slit which is adapted to be engaged by said tongue; and at least a second of said plies having no perforations in said second ply tear line in the region overlying said elongated slit, whereby said non-perforated portion of said second ply tear line has a greater resistance to tearing than said perforated portion of said second ply tear line such that when a bag is separated from said continuous roll, said bag tends to open.

2. The continuous roll of separable bags of claim 1, wherein each of said plies except for said second ply includes an elongated slit overlying each other.

3. The continuous roll of separable bags of claim 1, wherein said second ply is the uppermost ply which forms the front outside surface of said bag.

4. The continuous roll of separable bags of claim 1, wherein said second ply is the lowermost ply which forms the back outside surface of said bag.

5. A continuous roll of separable plastic bags for use in a dispenser which includes a separating tongue in a predetermined position, each of said bags comprising:

eight plies of flexible plastic film in a star sealed configuration;

a tear line in each of said plies, each of said tear lines overlying each other and including a perforated portion;

each of seven of said plies including an elongated slit, wherein each of said elongated slits overlies each other and is adapted to be engaged by said tongue; and one of said plies having no perforations in said tear line in the region overlying said elongated slits, whereby said non-perforated portion of said one ply tear line has a greater resistance to tearing than said perforated portion of said one ply tear line such that when a bag is separated from said continuous roll, said bag tends to open.

6. The continuous roll of separable bags of claim 5, wherein said one of said plies including no perforations in said tear line is the uppermost ply which forms the front outside surface of said bag.

7. The continuous roll of separable bags of claim 5, wherein said one of said plies including no perforations in said tear line is the lowermost ply which forms the back outside surface of said bag.

* * * * *